United States Patent [19]

Saxton et al.

[11] 4,095,795

[45] Jun. 20, 1978

[54] AMUSEMENT APPARATUS AND METHOD

[76] Inventors: James C. Saxton, 79 Georgetown Dr., Amherst, N.H. 03031; Bruce H. Osterberg, 12344 Escala Dr., San Diego, Calif. 92128; Joseph C. Kawan, 2034 Paramount Dr., Hollywood, Calif. 90068

[21] Appl. No.: 585,454

[22] Filed: Jun. 9, 1975

Related U.S. Application Data

[63] Continuation-in-part of Ser. No. 482,225, Jun. 24, 1974, abandoned.

[51] Int. Cl.[2] ..... A63F 5/04

[52] U.S. Cl. ..... 273/143 R; 273/138 A

[58] Field of Search ..... 194/1 M, 1 N, 1 E, 1 G, 194/97, 102, DIG. 1; 235/92 GA, 92 CN, 92 EA; 273/1 E, 138 A, 139, 143 R, 143 B, 143 C, DIG. 28, 85 R; 340/172.5, 323 R, 323 B

[56] References Cited

U.S. PATENT DOCUMENTS

| | | | |
|---|---|---|---|
| 3,606,337 | 9/1971 | Larsen et al. | 273/143 R |
| 3,642,287 | 2/1972 | Lally et al. | 273/143 R |
| 3,684,290 | 8/1972 | Wayne | 273/143 C |
| 3,688,276 | 8/1972 | Quinn | 340/172.5 |
| 3,874,669 | 4/1975 | Ariano et al. | 273/85 R |
| 3,876,208 | 4/1975 | Wachtler et al. | 273/138 A |
| 3,889,956 | 6/1975 | Castle | 273/138 A |

FOREIGN PATENT DOCUMENTS

| | | | |
|---|---|---|---|
| 41,594 | 2/1971 | Australia | 273/138 A |

OTHER PUBLICATIONS

101 *Basic Computer Games*; DEC, Maynard, Mass.; 1st printing, Jul., 1973; pp. 1-5, 198, 199.

*Primary Examiner*—Richard C. Pinkham
*Assistant Examiner*—Vance Y. Hum
*Attorney, Agent, or Firm*—Sellers and Brace

[57] ABSTRACT

An amusement or game device of the type wherein a plurality of symbol displaying devices are provided each comprising a respective series of symbols or indicia which are brought into display position repetitively in serial order following commencement of an operating or playing period. The finally displayed set of symbols representing a scope or lack thereof depends upon the composition of the set of symbols displayed at the termination of the operating period. The composition of that set is dependent upon computer operations consummated or effected at the commencement of the operating period, utilizing randomly generated number codes each representative of a particular symbol of the associated series of symbols. Scoring equipment is provided under the control of a computer to determine a play score in accordance with scoring schedule information stored in the computer memory. Similarly, the number and composition of the differing sets of symbols which merit a score constitutes information scoring likewise stored in the computer memory. Thus the score if any is completely and finally determined at the commencement of a playing operation. The score may be in the form of discs dispensed under computer control.

31 Claims, 13 Drawing Figures

WHEEL HOME INDEX PULSE
ONE SHOT
OPTIONAL SCORE ASSEMBLIES

DISC
DISC VALIDITY QUALITY SENSOR
DRIVE CIRCUIT (FIG. 5.)
ACCEPT CIRCUIT
REJECT
COMPUTER

WHEEL #3 STOP PULSE
WHEEL #2 STOP PULSE
WHEEL #1 STOP PULSE
WHEEL #1 START PULSE
WHEEL #2 START PULSE
WHEEL #3 START PULSE
WHEEL STOP PULSE
*NOTE: DISC ACCEPTOR SHOWN IN THE DISABLED MODE (DISC REJECT)

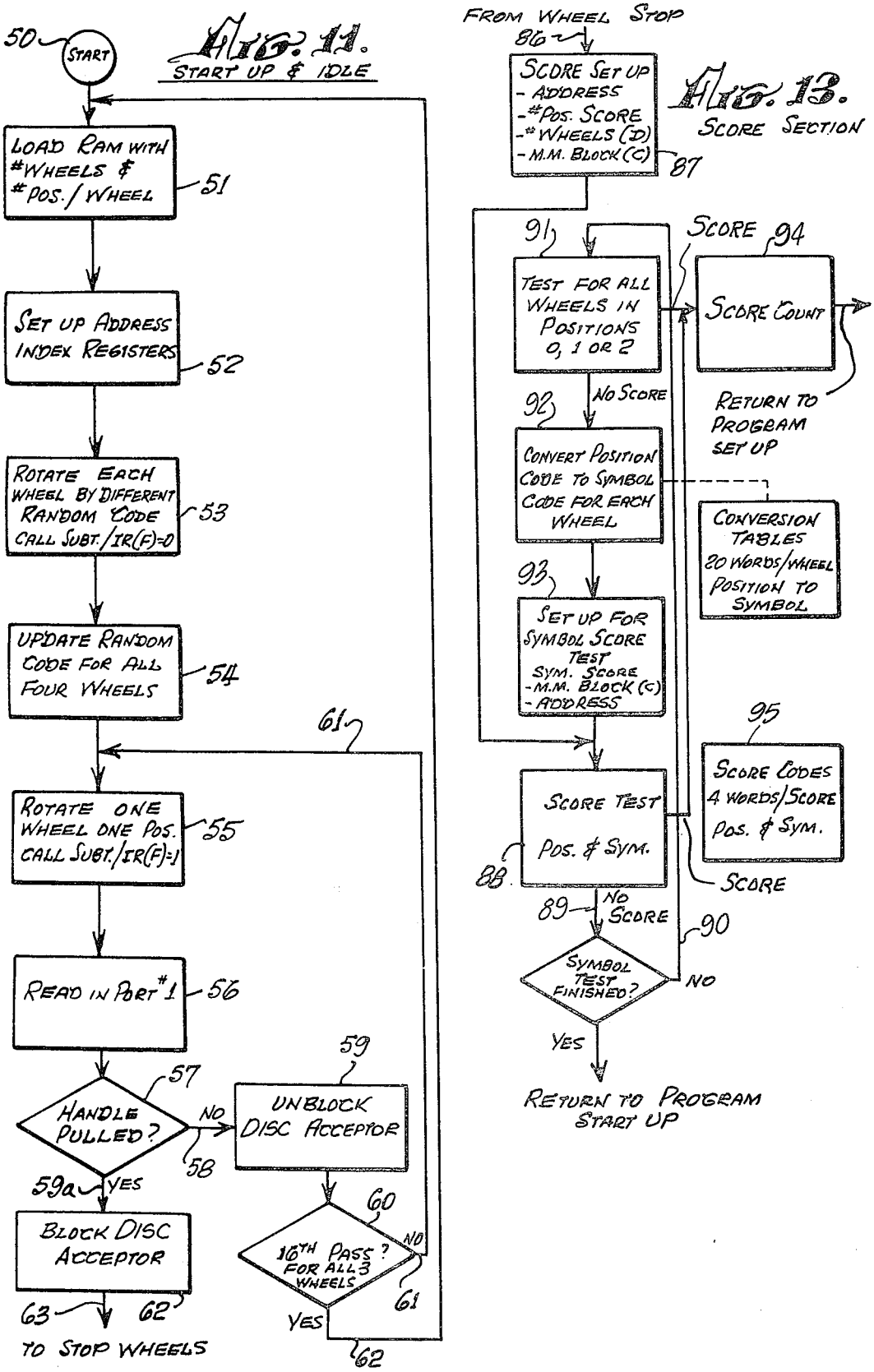
FIG. 11.
START UP & IDLE
50
START
LOAD RAM WITH #WHEELS & #POS./WHEEL
51
SET UP ADDRESS INDEX REGISTERS
52
ROTATE EACH WHEEL BY DIFFERENT RANDOM CODE CALL SUBT./IR(F)=0
53
UPDATE RANDOM CODE FOR ALL FOUR WHEELS
54
61
ROTATE ONE WHEEL ONE POS. CALL SUBT./IR(F)=1
55
READ IN PORT #1
56
57
HANDLE PULLED?
NO
58
59a
YES
BLOCK DISC ACCEPTOR
63
62
TO STOP WHEELS
59
UNBLOCK DISC ACCEPTOR
60
10TH PASS? FOR ALL 3 WHEELS
NO
61
YES
62
FROM WHEEL STOP
86
SCORE SET UP
- ADDRESS
-#POS. SCORE
-#WHEELS (D)
-M.M. BLOCK (C)
87
FIG. 13.
SCORE SECTION
91
TEST FOR ALL WHEELS IN POSITIONS 0, 1 OR 2
SCORE
94
SCORE COUNT
RETURN TO PROGRAM SET UP
NO SCORE
92
CONVERT POSITION CODE TO SYMBOL CODE FOR EACH WHEEL
CONVERSION TABLES 20 WORDS/WHEEL POSITION TO SYMBOL
93
SET UP FOR SYMBOL SCORE TEST
SYM. SCORE
-M.M. BLOCK (C)
-ADDRESS
95
SCORE CODES 4 WORDS/SCORE POS. & SYM.
SCORE TEST POS. & SYM.
88
SCORE
89
NO SCORE
90
SYMBOL TEST FINISHED?
NO
YES
RETURN TO PROGRAM START UP

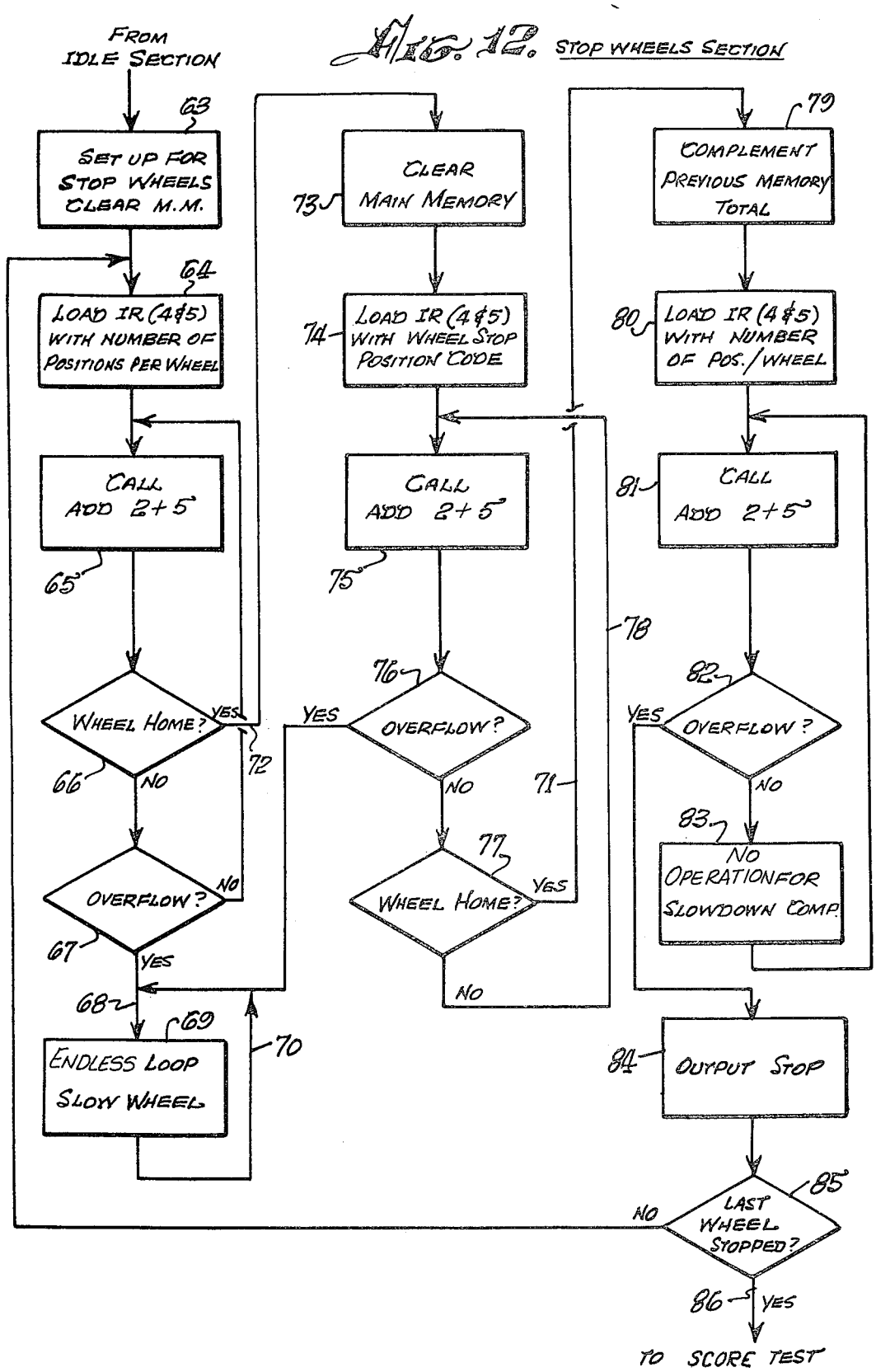
FIG. 12. STOP WHEELS SECTION
FROM IDLE SECTION
63
SET UP FOR STOP WHEELS CLEAR M.M.
64
LOAD IR (4&5) WITH NUMBER OF POSITIONS PER WHEEL
CALL ADD 2+5
65
WHEEL HOME?
YES
NO
66
72
OVERFLOW?
NO
YES
67
68
69
ENDLESS LOOP SLOW WHEEL
70
73
CLEAR MAIN MEMORY
74
LOAD IR (4&5) WITH WHEEL STOP POSITION CODE
CALL ADD 2+5
75
76
OVERFLOW?
YES
NO
77
WHEEL HOME?
YES
NO
71
78
79
COMPLEMENT PREVIOUS MEMORY TOTAL
80
LOAD IR (4&5) WITH NUMBER OF POS./WHEEL
81
CALL ADD 2+5
82
OVERFLOW?
YES
NO
83
NO OPERATION FOR SLOWDOWN COMP.
84
OUTPUT STOP
85
LAST WHEEL STOPPED?
NO
86
YES
TO SCORE TEST

AMUSEMENT APPARATUS AND METHOD

This application is a continuation-in-part of our application for United States Letters Patent Ser. No. 482,225, filed June 24, 1974, now abandoned.

Prior Art

The most popular game machines of this character are those with mechanical wheels (as opposed to electronic indicators) which are started into rotation by operation of a disc release handle. However, the mechanical units of such machines are more vulnerable to breakdown and "fixing", which is the physical forcing of an abnormally high score or number of awards. In the prior art game machine here of interest the wheels are stopped by mechanical means controlled by actions of the respective wheels. Thus the stopping positions of the wheels and the score or award may to some extent be controlled by shaking, tilting, or other manual manipulation or abuse of the machine while the wheels are rotating.

Examples of Prior Art

U.S. Pat. No. 3,269,503 to Foster describes a machine in which a jackpot of discs accumulated dispensed on the basis of a percentage set aside of the "investment" in one or a group of machines, when a particular winning combination of indicia, such as cards or fruits, appears in any one machine. The Foster device includes a percentage calculating unit in which values from the several machines are selectively entered into the jackpot accumulator in proportion to some predetermined percentage value. The minimum jackpot awarded is manually settable after an award has occurred.

U.S. Pat. No. 3,439,281 to McGuire, et al. describes a system for an indicia chance amusement device in which an electronic random signal generator controls the random displaying of indicia on an all-electronic display device. The indicia control means are partly operated by a pulse means prior to starting the game or amusement device, at which time the indicia display means is fully operated by the pulse means through the control means. The McGuirê et al. system is alleged to achieve randomness in this fashion. The pulse means is disabled after a period of time, after which stopping pulses fix the display. The indicia remaining in the display at the end of the game form the basis for determining whether or not there is a win. Means are provided to sample the outputs of the indicia means after it has stopped, for purposes of reward, if a rewardable output has occurred. The patent gives no indication regarding determining what is a "rewardable" display, except that "certain indicia" in the display will be rewarded.

U.S. Pat. No. 3,834,712 to Cox discloses a multi-wheel gaming machine employing an electronic control to produce a predetermined sequence of control pulses each corresponding to a predetermined counting state occurring at a random time after the starting operation. The machine includes means permitting the player to choose a winning symbol before a playing cycle with the expectation that this selection will correspond with the symbol or symbols displayed at the end of the play cycle or thereby increase his score.

U.S. Pat. No. 3,642,287 to Lally discloses gaming apparatus having symbol-bearing reels with means for spinning and indexing these reels to represent different scoring conditions on each playing cycle and including shutter means to mask the symbols of a particular reel. Control circuitry is utilized with both optional and automatic operations to cause withdrawal of the shutter in timed relation to the indexing of the particular masked reel to introduce variant award possibilities, interest and suspense.

U.S. Pat. No. 3,684,290 to Wayne discloses another electronically operated gaming device having an array of wheels the rotation of which is initiated by pulling an operating handle which trips a driving motor which in turn activates timing logic having plural timed outputs. Each of these outputs activates reel stopping mechanism and a time delay which then activates the next stopping mechanism until all reels have been stopped. The time delay logic is connected to position sensor boards which detect the relative positions of the reels and whether a scoring combination of symbols is displayed indicative of an award sequence; if so a diode matrix initiates a series of award logic signals to control a mechanical disc dispenser.

It is desirable to provide amusement apparatus which is operable in much the same manner as mechanical slot machines, insofar as the user is concerned, but in which once any operational setting has been established, it cannot be disturbed. Such apparatus should be tamper-proof and therefore will discourage and prevent undesirable physical shaking, tilting or like activity, fraud, or other misuse.

The present invention performs with very rapidly operating tamper-proof electronic means the essential control functions for a rotating wheel amusement machine. The electronic means is under control of nearly instantaneously acting computer means including a random code generating system, operating to govern machine operation and the time and the score. Thus the wheel stopping positions and possible score are determined by the computer means in an extremely short period of time and before any physical action on the part of the player can have effect on the score.

A random code generator is provided for each wheel symbol displaying means. A "wheel" may be either an actual physical symbol-bearing wheel, or a symbol readout device which is cycled through a sequence of different symbols by electronic means. The random code generator, by electronic or micro-computer simulation, cycles through a wheel or electronic symbol display cycle at a very rapid rate, e.g., in a few milliseconds.

The number of possible wheel stopping positions and the number of wheels are entered into a Random Access Memory (RAM) as an incident to initiation of each cycle of operation and are therein retained.

The random code generators, which are comprised in the computer system, continue to operate even when the apparatus is idle, setting up stop positions randomly for each wheel.

When a playing disc is inserted and accepted by conventional testing means, and the starting means initiated, the wheels or the electronically cycled symbol display are started through their cycles, and are stopped at the random positions determined by the random code generator. The wheels or cyclic symbol displays are stopped sequentially, each by a separate stopping device which is energized when the program-selected stopping position determined by the computer means has been reached for that wheel or symbol display unit.

In the programming of the computer means of the invention, various combinations of functional loops are used with require, for example, approximately from one millisecond to 20 milliseconds to occur. As a result, it is humanly impossible to predict how many cycles of any one or any combination of cycles of these loops will occur, based upon any past or previous position of any wheel or indicia displaying unit.

The improvement over prior art systems achieved by this invention is that an amusement apparatus, either of the multiple symbol-bearing wheel type or of the electronic-symbol display type, can be operated by random code generators to produce independent random stopping positions for each wheel or indicia display device, with a varying score previously determined by a predetermined logic system, when the wheels or indicia at which the displays have been stopped, are in the predetermined combination previously stored in a read only memory (ROM).

The description of the invention which follows, together with the accompanying drawings should not be construed as limiting the invention to the example shown and described, because those skilled in the art to which this invention appertains will be able to devise other forms thereof within the ambit of the appended claims.

FIG. 11 is a computer flow chart for the startup and idle functions of a system according to the invention;

FIG. 12 is a computer flow chart for the indicia or wheel stopping function according to the invention; and FIG. 13 is a computer flow chart for the scoring function of the exemplary machine according to the invention.

Figure 1:
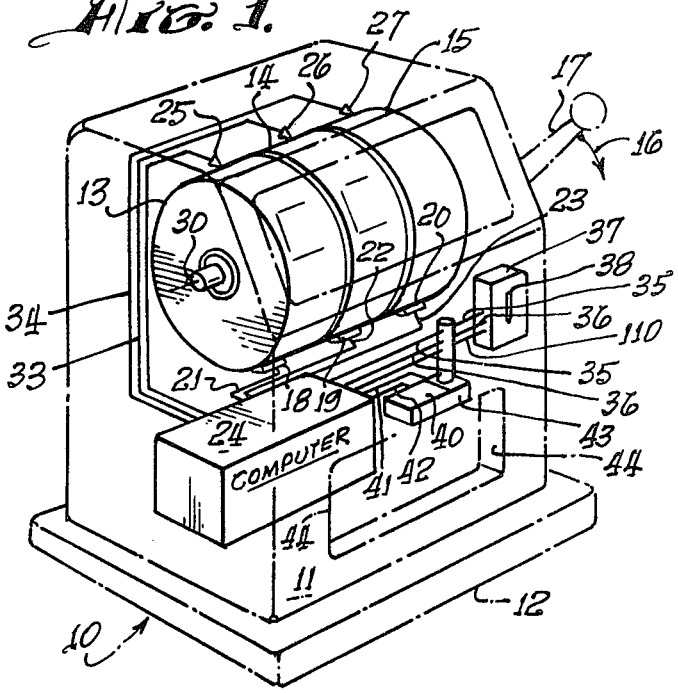
FIG. 1 is a perspective view of an exemplary indicia wheel amusement apparatus according to this invention, shown partly in phantom outline.

In FIG. 1, there is shown a representative form of the herein described exemplary indicia-bearing wheel gaming or amusement machine 10 according to the invention, which is similar in some respects to a conventional gaming machine of the indicia-bearing wheel type, and which incorporates the novel features of this invention.

Within a cover 11 of the machine 10, mounted on a base 12, is an array of at least three indicia-bearing wheels herein exemplified by wheels 13,14,15 freely rotatable on an axis 30. The number of indicia-bearing wheels employed in the gaming or amusement machine is a matter of choice, three being a customary number in machines of this character. The indicia-bearing wheels 13,14,15 are started in motion by a conventional spring loaded mechanism (not shown) actuated by downward movement of a handle or lever 17, as indicated by arrow 16. Lever 17 is coupled with magnet-operated switches and relay devices enabled for operation by a disc acceptor rejector mechanism shown in FIGS. 5, 6 and 7 and hereinafter described. The moving indicia-bearing wheels are stopped by the action of solenoid-actuated indexing stops 18,19,20 disposed in proximate relation, respectively, to wheels 13,14,15. Conductor leads 21,22,23 interconnect solenoid stops 18,19,20 with a micro-computer 24 which provides indexing stop signals to energize the solenoid stops 18,19,20 in accordance with the particular program residing in the computer memory.

Computer 24 is a computer means of known type, comprising a random access memory (RAM), a central processing unit (CPU) or arithmetic unit, a read-only memory (ROM) into which is "written" or stored the control instructions, either by the manufacturer of the computer or by the owner of the machine, and other conventional auxiliaries such as registers, a computer clock, and input and output ports. The general nature and operation of micro-computers is detailed in the manufacturers literature, and may be such as described in the May 1975 issue of Scientific American, following principles of design set out in computer art publications of which the text DIGITAL COMPUTER DESIGN by Edward L. Braun, published 1963 by Academic Press, New York, New York, and references cited therein, are exemplary and typical. A presently preferred computer means is a micro-computer labeled MCS-4, produced by Intel Corporation of Santa Clara, California and listed in the catalog of that company for October 1973 at pages 6-1 through 6-4.

Wheel start positions sensors 25,26,27, which may be photoelectric, or of any other character such as magnetic, photo-optical, electro-optical, or other, are in proximity to wheels 13,14,15 respectively, and may preferably be positioned at a point diametrically opposite the wheel indexing stops 18,19 and 20.

Figure 9:
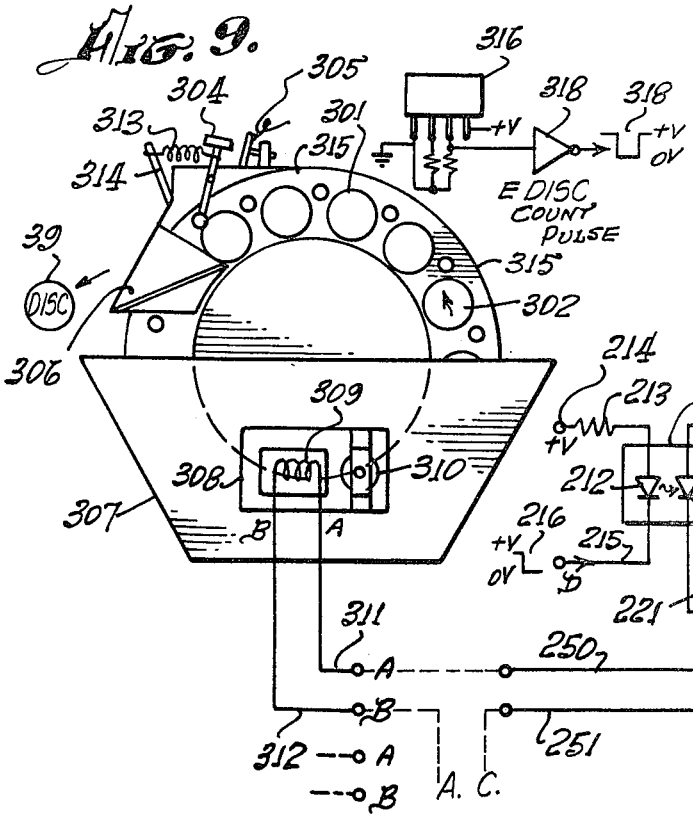
FIG. 9 is a diagram of a disc dispensing or scoring device usable in the invention, employing the circuit of FIG. 8.

Position sensors 25,26,27 are arranged to detect a starting indicium on each indicia-bearing wheel. As hereinafter described, this may be accomplished by transmission of light through the wheel periphery (if translucent) or through a slot in the wheel peripheral surface, or by light reflection of a reflective tape which can be positioned on the outside of the wheel at the "homing" spot or starting position of wheel rotation, so that the number of rotations can be sensed. Magnetic sensors also may be utilized. Leads 32,33 and 34 connect sensors 25,26,27 to computer 24. Leads 35,36 from computer 24 are also connected to a disc acceptor mechanism 37, which determines whether discs inserted into the machine 10 are legitimate and of the proper characteristics for operating the machine to release the starting lever 17. A slot 38 in disc acceptor 37 is accessible from the exterior of the cover 11 for insertion of playing discs therein to permit use of the machine 10. Also within the cover of the machine 10 is a scoring mechanism 40 connected by leads 41,42 to computer 24. In mechanism 40 there is a discharge aperture 43 opening into dispensing window 44 in cover 11. A disc storage chute 45, FIG. 10, extends from scoring mechanism 40, and a typical playing disc 39 is shown being dispensed or discharged from mechanism 40. In FIG. 9 another form of playing disc dispensing mechanism is shown, known as the Bally device, which may be utilized with the invention.

As noted, computer means 24 comprises a micro-processor, one of a number of types well known in the computer art, which perform functions in accordance with a program set or entered into the computer memory by conventional means and methods. In response to various events as they occur, out-put pulses are produced by the computer for energizing or actuating selected devices which operate other devices as the operating pulses are generated by the computer. Programming of the computer follows conventional computer programming practice, and may, for example, be according to principles set out in the DIGITAL COMPUTER PROGRAMMING by D. D. McCracken, ublished in 1957 by John Wiley and Sons, Inc., New York, New York. The specific exemplary program used in the exemplary Intel micro-computer is set out in detail on pages 1 to 16 at the end of this specification. Other known micro-processors can be utilized as well in practicing this invention.

The computer "program" or operation is illustrated by the flow charts of FIGS. 11, 12 and 13. As noted, micro-computer 24 has a random access memory (RAM), an input-output portion, a central processing unit and a ROM (read only memory).

Table I sets forth a memory collection for the random access memory (RAM) within the micro-processor. Table II indicates the assignments for the index registers of the micro-computer.

TABLE I (RAM 11)

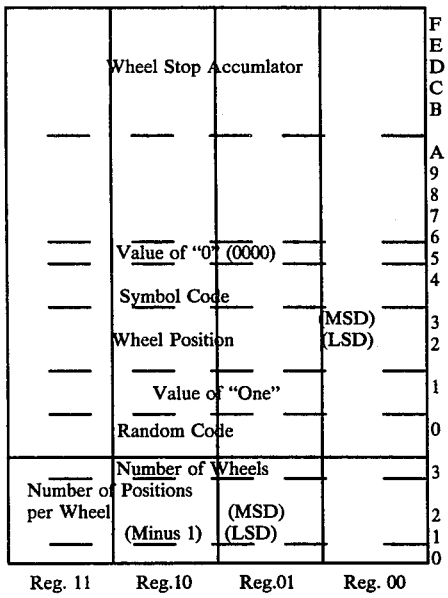

TABLE II

| | Index Register Assignments |
|---|---|
| IR (0 & 1) | - Score code address |
| IR (2 & 3) | - Score code |
| IR (4 & 5) | - Value for "Add 2+5" subroutine |
| IR (6 & 7) | - RAM address registers |

TABLE II-continued

| | Index Register Assignments |
|---|---|
| IR (8) | - I/O Port address register |

Table I is essentially the same truth table configuration as that shown in the aforementioned INTEL DATA Catalog at Page 6—6, describing the INTEL Model 4002, 320 bit RAM and 4 bit input/output port. The RAM mode of operation is depicted in Table I. The data stored in the RAM includes in main memory slots B,C,D,E,F, of Registers 10, 01 and 00 wheel stop accumulation data derived from the rotation time of each indicia-bearing wheel, divided by the number of symbols or indicia on the wheel related to the output code of the random number generator for that wheel, as entered in the main memory of the RAM.

In Table III, an exemplary truth table is shown for a random code generator cycle for one of the wheels.

TABLE III

| 8 | 4 | 2 | 1 | |
|---|---|---|---|---|
| 0 | 0 | 0 | 1 | 1 |
| 1 | 0 | 0 | 0 | 2 |
| 1 | 1 | 0 | 0 | 3 |
| 1 | 1 | 1 | 0 | 4 |
| 1 | 1 | 1 | 1 | 5 |
| 0 | 1 | 1 | 1 | 6 |
| 1 | 0 | 1 | 1 | 7 |
| 0 | 1 | 0 | 1 | 8 |
| 1 | 0 | 1 | 0 | 9 |
| 1 | 1 | 0 | 1 | 10 |
| 0 | 1 | 1 | 0 | 11 |
| 0 | 0 | 1 | 1 | 12 |
| 1 | 0 | 0 | 1 | 13 |
| 0 | 1 | 0 | 0 | 14 |
| 0 | 0 | 1 | 0 | 15 |
| 0 | 0 | 0 | 1 | 16 |

Referring to FIG. 1, the micro-computer 24 includes means including the programming, as noted, for producing a random sequence of binary digital numbers corresponding to indicia item positions on the wheels 13,14,15. During the period in which the machine is idle and awaiting insertion of an enabling or playing disc 39, see FIG. 2 and 10, into slot 38 of disc acceptor 37, the micro-computer 24 cycles through the random number of sequences. There are, for example, three different sequences which are set up or entered into the program memory by the machine manufacturer from punched cards or other known information entry means. There is a random number code sequence for each of the wheels in the machine. An example of a wheel rotation simulation binary number sequence is set forth in Table IV.

At the instant a disc is inserted into slot 38 and accepted by acceptor 37, the cyclic run-through of the random number sequences for each of the wheels terminates, and the binary digital number then present, representing the wheel position at which the particular wheel will be stopped, is loaded into the random access memory (RAM) of micro-computer 24.

The sequence of operations of the wheel rotation simulation during the idling process is as follows:

1. Move one step through the cyclic random number sequence for wheel no. 1.

2. Check for disc acceptance and handle pulled indication. (If both have occured at this time, then freeze wheel position binary digital codes at this instant, and proceed to transaction operation sequence.)

3. Repeat steps 1 and 2 for each of the remaining wheel position binary digital codes.

4. Repeat steps 1, 2 and 3 sixteen times.

5. Step through the random code sequence for wheel no. 1 (as in Table III).

6. Repeat step no. 5 for each of the remaining wheels.

7. Update all wheel indicia sequence indications (binary digital random codes).

8. Return to step no. 1.

Note that at step 2 above if the disc acceptance and wheel-pulled signals have occurred after some number of cycles of operation, the RAM entry will have occurred for each wheel position number present at that instant. While the cycling may continue, the only wheel position data in the RAM is that established at the instant of disc acceptance and wheel pull coincidence with that position number in the random sequence of Table III, for each of the wheels.

A further description of the sequence is detailed in connection with the flow chart of FIG. 11.

TABLE IV

INPUT SIGNALS

Input Port #0 Home Port $I_o$ Home signal for wheel #1 ($I_o = 0$ = Home) between 0.63 ms and 1.37 ms.

$I_1$ Home signal for wheel #2 ($I_1 = 0$ = Home)

$I_2$ Home signal for wheel #3 ($I_2 = 0$ = Home)

$I_3$ Home signal for wheel #4 ($I_3 = 0$ = Home)

Input Port #1 Mode Port $I_o$ Handle pulled signal, ($I_o = 0$ = Pulled)

$I_1$ (Not Used)

$I_2$ (Not Used)

$I_3$ (Disc Pulse) ($I_3 = 0$ = Disc Score Counting Detected)

OUTPUT SIGNALS

Output Port #0

$0_o$ = Stop pulse signal for wheel #1 ($0_o = 0$ = Stop)

$0_1$ = Stop pulse signal for wheel #2 ($0_1 = 0$ = Stop)

$0_2$ = Stop pulse signal for wheel #3 ($0_2 = 0$ = Stop)

$0_3$ = Stop pulse signal for wheel #4 ($0_3 = 0$ = Stop)

Output Port #1

$0_o$ = Block Disc Acceptor ($0_o = 0$ = Block)

$0_1$ = Score Enable ($0_1 = 0$ = Award)

$0_2$ = OFF request (shutdown) ($0_2 = 0$ = OFF)

$0_3$ = SLOW Wheel Alarm ($0_3 = 0$ = SLOW)

Hi = 1 - True

Lo = 0 = False

In Table IV, there are listed significant input and output signals employed in and by the operation of the micro processor control system of this invention.

Figures 2, 3, 4, 7, 8, 9, 10:
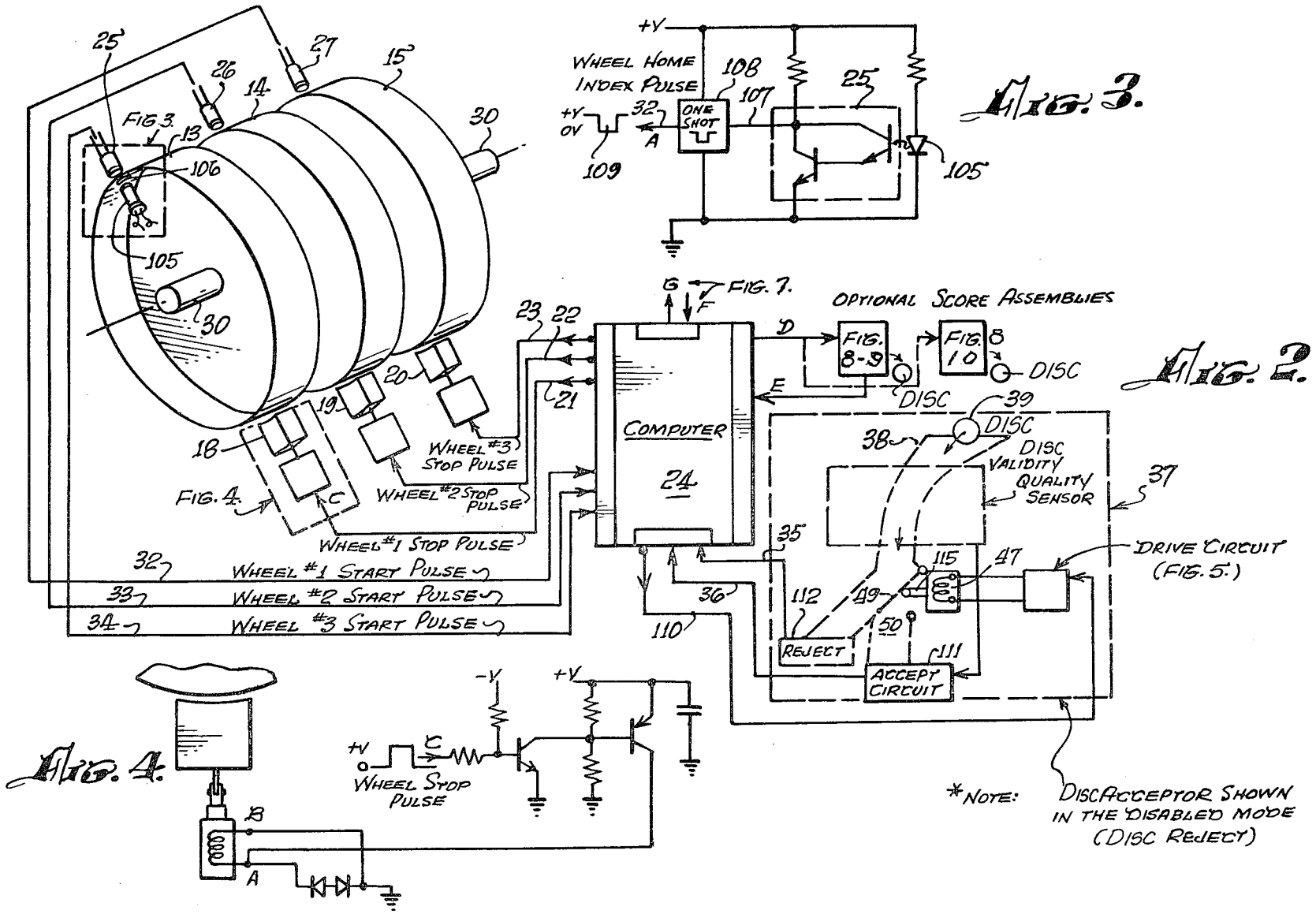
FIG. 2 is a combination block and schematic diagram of the exemplary system of the invention shown in FIG. 1.
FIG. 3 is a circuit diagram of an optical sensing mechanism for producing a wheel home index pulse as used in the invention.
FIG. 4 is a schematic diagram of a solenoid drive circuit indexing means which stops an indicia wheel at a position determined by a stop pulse applied thereto.
FIG. 7 is a schematic circuit diagram of the handle-pull signal and reset pulse generator system utilized in this invention.

The "home" signals ($I_1$, $I_2$, $I_3$, and $I_4$), shown in Table IV are the starting point signals for each wheel identified in the table and are derived from sensors 25,26,27 etc., shown in FIG. 1, and on leads, 32,33,34, as inputs to computer 24, these connections also being shown in FIG. 2 in more detail.

The handle pulled signal ($I_o$) occurs upon completion of a sequence of pulse events, further described below, derived from the operation of magnet 101 on handle 17 sequentially passing magnetic semi-conductor sensors 102 and 103 (FIG. 6), as illustrated in the circuits of FIG. 7.

The disc pulse ($I_3$) at input port #1 is the playing disc acceptance pulse derived from disc acceptor 37. The sensing mechanism may be of any character capable of determining the fact of acceptance of a disc, such as an eddy current sensor, a magnetic sensor, or simply a switch contact.

The micro-computer 24, acting upon the programmed conditions for which it has been set, when it receives the "home" or starting point signals, determines the time between successive starting point signals, and divides this time into units equal to the number of symbols or indicia on the respective indicia-bearing wheel. For example, a wheel may have any number of symbols or indicia, but generally there are 20. Counting these symbols or divided units, the microcomputer issues a stop pulse signal to actuate the index stop solenoid, such as 18, 19, or 20, at the previously determined wheel position. It will be apparent to those familiar with such amusement devices that the wheels, once started, continue to rotate as long as they are free to do so, and if not stopped will slow down in time due to friction. The time interval between successive start pulses on any wheel increases as slow-down occurs. This time interval, divided by the number of symbols or indicia on the wheel, is monitored and updated during wheel rotation. Thus, the stop pulse can be inhibited if the wheel rotation is too slow, as might occur if an attempt is made to interfere with the normal rate of rotation at any instant. The result, as indicated at output port #1, $O_3$ (Table IV) will produce an alarm signal or, if the wheel rotation is slow enough, will produce off-signal $O_2$ in output port #1 to shut the machine down in a "tilt" reaction.

While awaiting the insertion of a disc and a signal indicating acceptance of the disc and a signal indicating that the wheel-rotation starting handle 17 has been pulled, the computer idles, during which time each random code generator means of computer 24 cycles through its code sequence as hereinbefore described, in accord with its control program.

FIG. 11 is a flow diagram of the Idle mode operation, during the course of which the random code generator means (an exemplary truth table for which has been shown in Table III) is exercised. It is the loop in the program set out in FIG. 11 in which the stop position for each of the wheels 13,14,15 is determined. Starting at the top 50 of the flow diagram, the first step 51 is to load into the RAM the data relating to the number of wheels (one, two, or three) and the number of positions per wheel (1 through 3 [table I]). This is redone each cycle of the loop, primarily for reliability. If there is an electrical transient, this information is not lost. The next step is to set up the address Index Registers, also for reliability (refer to Table II).

There are a plurality of random code generators (RCG"s) 52 and 53 within the micro-computer unit 24, one for each of the wheels 13,14,15, etc. Each random code generator causes the respective wheel rotation simulation to be "rotated" over or progressed through a number of positions determined by the random code for that wheel. This is done by calling the SUBT sub-routine (Block 53) with index register F set to zero. The subroutine is recalled for each of the wheels.

The next operation 54 is to up-date the random code for all of the wheels. This is a housekeeping routine. The random code generator is a pseudorandom shift register, modulus 15. The next steps (55 through 61) form a minor loop. This loop is used to further complicate the stopping position of the wheel. The first instruction is to rotate one wheel one position and is accomplished by calling the SUBT subroutine with index register F set to one (55). The second instruction is to read in port #1 (56), the port that signals whether the handle has been pulled or not. If the handle 17 has been pulled (59), then the next operation is to disable (62) the disc acceptor 37. Then proceed (63) directly to the Stop Wheel section (FIG. 12). If the handle 17 has not been pulled (57 and 58), then enable (59*a*) the coin or playing disc acceptor 37. This is an operation that is repeated so long as the handle 17 has not yet been pulled (57, 58, 59*a*, 60 and 61).

If this is the 16th time the minor loop has been exercised, then the program automatically returns to the start of the flow chart at 50.

In the exemplary micro-processor herein described, the minor loop (55-61) requires approximately one millisecond to execute. The major loop with 16 minor loops requires approximately twenty milliseconds. Therefore, it is impossible for one to predict how many cycles of either one, or combination of the cycles of these two loops will occur based upon any past position. With respect to security, it is to be noted that the code derived from the random code generator cannot be determined externally of the machine, hence the effect of the code on any wheel or indicia positions cannot be established even if the above referenced cycles were to be predicted from a table such as Table III.

FIG. 12 is the flow diagram of the Stop Wheel section of the micro-computer 24. This is the portion of the program that actually initiates stopping of the wheels. The first steps (block 63) are housekeeping instructions. The second block 64 loads the index registers 4 and 5 with the number of positions per wheel. The first instruction 65 of a minor loop is to call the ADD 2 + 5 subroutine (Table II). This minor loop is repetitively exercised until the wheel home signal is detected (66). The wheel home signal is a pulse of approximately one millisecond on each rotation of the selected wheel. This pulse is coincident with the time when position zero (the start position) of the wheel is at the stop solenoid position. The pulse is derived from the complementary one of sensors 25,26,27, depending upon which wheel (13, 14 or 15) is being controlled.

In the program executes this minor loop 65,66,67 enough times to cause an overflow 67,68, then it is assumed the wheels are too slow to predict accurately or that the wheel has been jammed. It takes a finite period for this overflow condition to occur. At that time the program enters an endless loop 69,70,68 from which it cannot exit until there is a power on-off cycle.

When a wheel home signal is first detected (66) (72) the main memory is cleared (73), index registers 4 and 5 are loaded with the wheel stop position code (74). The same minor loop 75,76,77 is used to time the revolution of the wheel. If an overflow occurs (76) the wheel is too slow and the endless loop 68,69,70 is entered.

When the wheel home signal is sensed (71), then the main memory total is complemented (79) and index registers 4 and 5 are loaded (80) with the number of positions per wheel. Then the minor loop of ADD 2 + 5, check overflow, and 0, 1, 2, or 3, "no operation" instruction for slow down compensation, are executed (81) (82) (83).

The predicting of the stop position can best be explained by an example. Assume the number of positions per wheel is twenty and the wheel stop position is five. Therefore, in the middle loop 75, 76, 77, 78 the ADD 2 + 5 routine will continue to add five upon itself continuously until the next home signal 71 is sensed. Assuming it takes 1,000 cycles of the minor loop to execute this, then the accumulated total is 5,000. Then complement (subtract from 0), and start adding twenty per cycle of the minor loop until over-flow (76), which will occur in 250 cycles of the minor loop, or approximately ¼ of time for the rotation of the wheel. At this instant the wheel indexing stop solenoid 18,19, or 20, etc. is energized to stop the wheel's rotation. This stop-step process of first finding the home position, then timing the next complete wheel rotation, and then determining the instant to actuate the associated one of the wheel indexing stop solenoids 18, 19, or 20 is repeated for each wheel.

FIG. 13 is a flow diagram of the scoring section. This award section of the program is executed upon every pull operation of handle 17, after the wheels have been stopped. Note that the wheel stop positions are determined at the instant a handle pull signal is detected.

The first position 87 of this flow chart section is set up. The number of score positions, number of wheels and number of symbols for scores are determined by one sequence of instructions. The next operation is testing (88). The same sequence is used to test for scoring positions awards. This test (88) is executed for each number of scoring positions which are determined in the set-up section 87. When this is done, and if there has been no score (89), the next operation is to check whether the tests for scoring symbols have been executed. If the answer is "No" (90), then proceed to test for all wheels and position 0, 1, or 2 (91). This is a symbol located in any one of the positions for each of the wheels.

To test for a scoring symbol, the position code for each wheel is converted to a symbol code 92. After set-up of (93), the same scoring test sequence used for the scoring positions is repeated for each of the number of scoring symbols (88).

If a scoring code was detected during testing in any one of the three scoring test categories, the programs proceed immediately to the scoring section (94). The score count section first fetches from ROM the score code. This scoring code is fetched in 2's complement. As the scoring discs are vended or dispensed, this count is decremented until it reaches zero, indicating that the proper number of scoring discs has been dispensed.

All of the tables that contain the position-to-symbol conversions and the scoring codes are constructed in such a way that if the operating program is interrupted by some transient or other artifact, there will be no significant effect on the operation, because these codes are executed as operational instructions rather than as data. The resulting transient does not produce a score under any conditions, and normal operation is eventually resumed. It is assumed that the transient or other artifact is user initiated. This is the tamper-proof feature of the invention, and may be likened to a "tilt" function in pin ball machines.

The odds, number of wheels used, or number of wheel positions can be changed by appropriate instructions or program changes, as hereinafter set forth.

Two words are used for the number of positions per wheel which are loaded into the program. If a different number of positions per wheel is to be used, then these are the only two instructions that must be changed.

Only one word must be changed for a different number of wheels. Note, however, that the exemplary program is limited to use with three or four indicia display devices such as the noted wheels.

Changing of the scoring odds can be done in one of two ways. The first is to increase the number of scoring positions, and the second is to add more symbols for scores, etc., to a particular wheel. This can be done by changing the conversion tables. Note that the scoring codes may occupy 11 × 4 words of memory (44 words of memory). Therefore, approximately 6 different scoring tables can be stored in one ROM. These different scoring codes could be selected by manually operable jumpers or patch cords.

Referring again to the drawings, and particularly to FIG. 2 wherein a preferred exemplary form of a system according to this invention is illustrated schematically, the indicia-displaying wheels 13,14 and 15, are shown to have cup configurations. Wheel 13 has sensor 25 positioned opposite a lamp 105. The rays from lamp 105 on the inside of wheel 13, impinge on sensor 25 when a wheel start aperture 106 in the peripheral surface of the wheel passes between lamp 105, which may be a light emitting diode, and the sensor 25.

As previously mentioned, magnetic, reflective, or contact start-position sensors may be used in place of lamp 105, aperture 106 and sensor 25.

The start-position sensor outputs on lines 32, 33, 34, etc. are applied to micro-computer 24 at the inputs $I_1$ to $I_4$, as previously described in connection with Table IV, where they are also identified as "home" signals or wheel start pulses.

FIG. 3 shows a circuit diagram of the photo sensor which provides the wheel home or start index pulse. This circuit includes an exemplary sensor 25, which is Darlington photo sensor amplifier of known commercial design. This is excited by light emitting diode 105. The output from the Darlington photo sensor amplifier is applied via lead 107 to a one-shot multivibrator 108 to produce the start of revolution, or wheel home index pulse 109 which pulse is fed to computer 24 via lead 32. If a photo sensor system, such as that hereinabove described, is used in the invention, all of the wheels will have identical circuits, with output pulses such as 109, on lines 32, 33 and 34, etc. applied to computer 24. An exemplary multivibrator as shown at 108 is that known in the trade as Fairchild 9601.

Another input to computer system 24 is supplied via lead 36 (FIG. 2) from disc acceptor system 37.

Disc acceptor mechanisms, such as that shown in block 37, of FIG. 2, are well known. A full explanation of a typical prior art disc or token tester mechanism is given on page 324 and 325 of "The Way Things Work" (hereinbefore cited). In the prior art unit, weight and size of discs are tested by springs and calipers. Magnetic devices are used to test quality. Rejected discs are discharged by gravity-operated lever devices. Acceptable discs are accepted by appropriate movement of weight and size sensors and magnets.

As shown in block 37 of FIG. 2, the disc acceptance mechanism includes conventional means 111, 112 to indicate acceptance or rejection of a disc 39 inserted in slot 38. If accepted, an acceptance signal is produced by a means 111. The means 111 may be similar to that in FIG. 3, if a photoelectric means is used, or like those in FIG. 7 if magnetic sensing is used. The disc-acceptance signals are applied to computer 24 on line 35. The responsive reaction of computer 24 to the disc-acceptance signal from unit 111 is an output signal produced on line 110 and applied to the drive circuit of FIG. 5.

Figure 5:
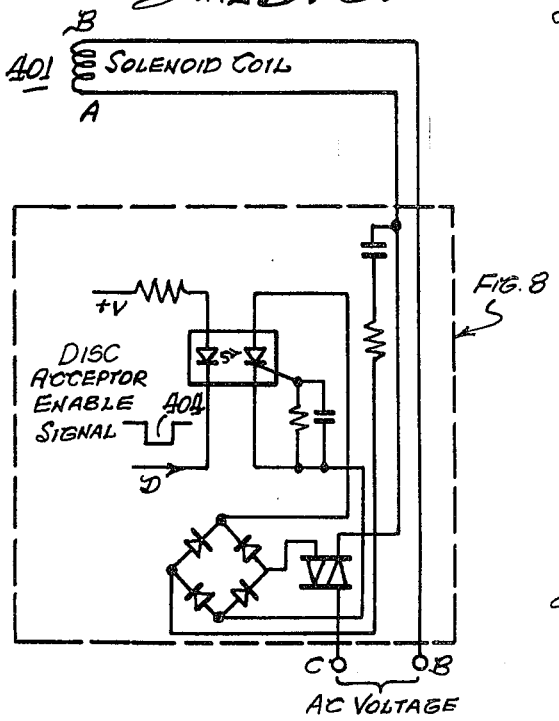
FIG. 5 is a circuit diagram of a drive circuit for the disc acceptor enable system as utilized in the exemplary illustrated embodiment of the invention.

The circuit of FIG. 5 illustrates how the normally extended solenoid pin 115 in the deenergized state of solenoid 47 (FIG. 2) maintains the disc chute door 49 in a reject position due to the operation of the circuit 112 when any one of the following conditions occur:

1. When the amusement apparatus is inoperative due to power shut off; or

2. A disc has been inserted into the machine but the machine is still in a play cycle from a prior disc insertion and operation; or 3. An unacceptable disc has been deposited.

Insertion of an acceptable disc results in a disc accepted enable signal pulse 404 (FIG. 5), as described earlier, which appears on line 110 (FIG. 2) from disc testing means 111 to computer 24 and initiates a return signal from computer 24 to the solenoid drive circuit (FIG. 5) to operate solenoid 47, withdrawing plunger 115 so that acceptable disc 39 may drop into the collection chute 50, by release of trap door 49.

Figure 6:
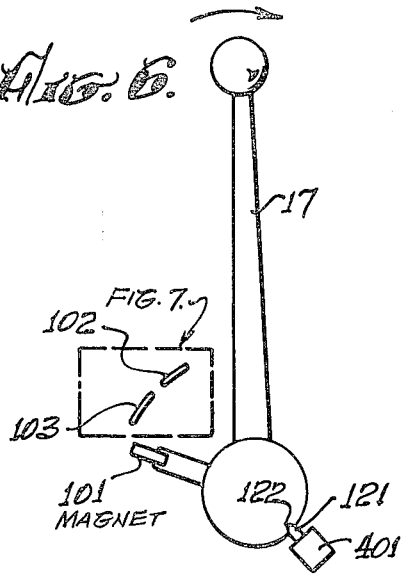
FIG. 6 is a combination mechanical and schematic diagram of the pull handle mechanism and its signal generating system, as utilized with the invention.
Figure 7:
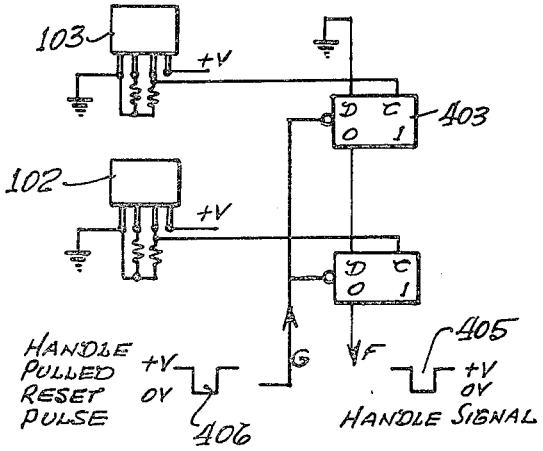

The disc acceptance means 111 produces also a signal 116 through computer 24 to handle lock relay 401 which is shown in FIG. 6. A drive circuit, such as that shown in FIG. 8, is also utilized to respond to signal 116 to drive solenoid 401.

In FIG. 5 a representative disc sensor circuit is shown. In FIG. 6 a representative handle-pulled sensor and handle lock circuit are shown. In FIG. 7 details of the electronics relating to handle 17 are shown, and in FIG. 8 is shown a circuit diagram of a drive circuit utilized generally in the control system as hereinafter described.

Figure 8:
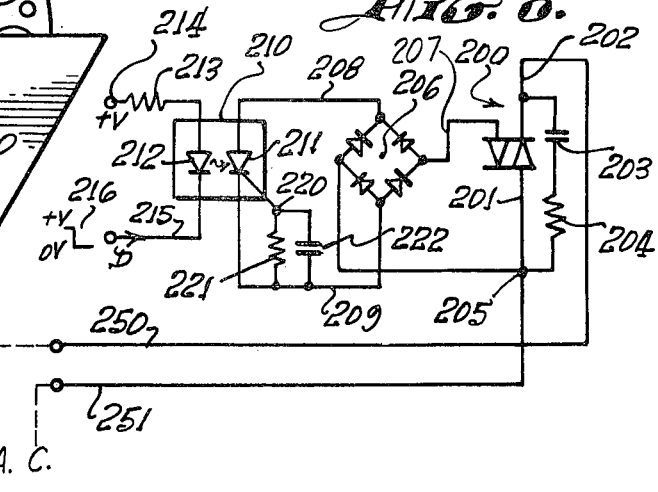
FIG. 8 is a schematic circuit diagram of an A-C solenoid/relay driver as used in the invention.

Referring first to FIG. 8, the basic solenoid drive control circuit is shown whereby a solenoid such as 309 in FIG. 9 is driven from the a-c power source when a bilateral SCR switch 200 (usually called a triac) is triggered by a signal applied to its gate electrode 207. The diode formed by anode-cathode electrodes 201, 202 conducts, when the gate 207 is excited, to close the a-c circuit to a solenoid coil connected at 250, 251 in FIG. 8.

The tripping signal applied to gate 207 is derived from application of potential level change at 216, to an opto-isolator, such as that illustrated at 210. The opto-isolator consists of a light emitter 212 which excites a light detector 111, both in the opto-isolator 210. The output of isolator 210 is a series of pulses on lines 208-209 which are applied to and rectified by bridge rectifier 206 to apply a d-c gate potential change to gate 207 so long as a potential change or a sequence thereof are present. Thus a solenoid coil such as 401, or 309 or 400, or 47 or other device connected at 250-251 is actuated so long as the potential change at 216 occurs.

Figure 10:
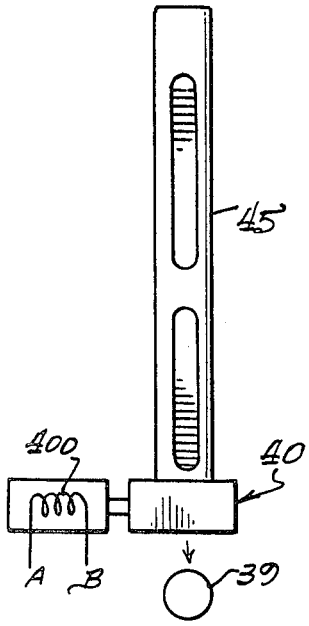
FIG. 10 is a mechanical schematic diagram of another disc dispensing or scoring system usable with the invention, actuated by a solenoid driven by the circuit of FIG. 8.

The potential change at 216 may represent a drive signal from micro computer 24 to operate a disc dispenser solenoid 400 such as 40 in the scoring portion of the machine, as shown in FIG. 10. Alternatively, the motor 309 in the disc dispenser of FIG. 9 may be driven by the circuit shown in FIG. 8. In any event, the drive signals are such as those appearing on lines 41, 42 from micro-computer 24 to scoring mechanism 40, as seen in FIG. 1.

In FIG. 5 a lock solenoid 401 is shown connected to a circuit like that of FIG. 8. The input pulses 404 are derived from the disc acceptance mechanism 37 of FIG. 1, and are supplied in computer 24 to the actuator handle arm lock of FIG. 6 on lines 35, 36 shown in FIG. 1. Disc acceptance signals 404 (FIG. 5), when present, actuate solenoid 401 by operation of the circuit of FIG. 8 to unlock handle 17 so that it may be pulled to start indicia-displaying symbol wheels 13, 14, 15, etc. into rotation.

The handle lock mechanism 401 has a pin 121 which engages a notch 122 in the handle 17. The enable signal from computer 14 operates the circuit of FIG. 8, which is similar to that of FIG. 5, related to the disc acceptor enable signal 404. When both disc acceptance and handle release have occurred, the handle 17 is pulled through a cycle such that magnet 101 on the handle passes magnetic solid state sensors 102, 103, 103, 102 in that sequence to produce a handle-pulled signal 405, (FIG. 7), the occurrence of which signal, applied both to computer 24 and the wheel start signals, selects the wheel stop output signals for that operation from the random number code generator, which then enter the RAM for storage until later used in wheel stopping.

The return of the handle 17 to the rest position results in reset pulse 406 (FIG. 7) resetting sensors 102, 103 for succeeding sequence of handle pull pulses or signals therein.

Another circuit system employing the circuit of FIG. 8 is the disc dispensing system shown in FIGS. 9 and 10. Either of these may be used to dispense discs in response to scoring signal which would correspond to 216 (FIG. 8).

The scoring signal originates in computer 24 when a sequence of wheel stop signals at the computer-selected symbol stop positions (corresponding to a particular set or combination of indicia or symbols) are matched against pre-programmed (stored) scoring symbol signals derived from the ROM of computer 24, as hereinbefore described.

From the preceding descriptiOn it is evident that the principal objects of the invention are attained by the provision of a plurality, n, of like indicia-or symbol-displaying means each cyclically operable to display in serial order a plurality m of indicia or symbols, such as numbers or "fruits", which displaying means are operatively associated with operation-initiating means and operation-terminating means arranged to conditionally initiate repetitive serial display of the symbols or indicia. Included in combination with the foregoing are means for producing a continuing series of random number codes and for storing one of the codes for each of the displaying means commencing with initiating operation of the symbol displaying means, and means for subsequently so timely activating the operation-terminating means that each displaying means displays the symbol or indicia corresponding to the previously recorded random number code.

While the particular amusement apparatus and method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

We claim:

1. An amusement apparatus comprising: a plurality of like symbol-displaying means for repetitively displaying respective series of symbols sequentially during an operating periOd of said apparatus, and computer means effective to select at the commencement of each operating period a single complete set of said symbols comprising one symbol of each of said displaying means and including means causing displaying of said selected set of symbols at the end of said operating period.

2. Apparatus as defined in claim 1 characterized in the provision of playing disc dispensing means operatively associated with said computer means and effective to dispense playing disc determined in accordance with a scoring schedule stored in a memory means of said computer means.

3. Apparatus as defined in claim 2 characterized in that said computer means includes means for storing a plurality of differing scoring schedules, and said playing disc dispensing means effective to dispense playing discs in accord with a computer selected one of said scoring schedules.

4. Apparatus as defined in claim 1 including means connected with said symbol displaying means for initiating and terminating each operating period.

5. Apparatus as defined in claim 4 in which said operating period initiating means comprises inhibiting means for inhibiting commencement of an operating period, and means for disabling said inhibiting means.

6. Apparatus as defined in claim 5 in which said playing period initiating means comprises manually operable means, and said inhibiting means comprises means for locking said manually operable means against manual operation.

7. Apparatus as defined in claim 6 wherein a disc and disc utilizing means operating in conjunction therewith and effective when disc means is present in said disc utilizing means to disable said inhibiting means.

8. Apparatus as defined in claim 7 in which said disc utilizing means is utilized to dispense a playing play disc under the control of said computer means.

9. Apparatus as defined in claim 8 in which said disc utilizing means is controlled by said computer means to dispense a determined number of said discs in accordance with scoring information stored in a memory of said computer means.

10. Apparatus as defined in claim 1 in which said plural symbol displaying means each comprise a rotary wheel bearing a circumferentially arranged series of symbols.

11. Apparatus as defined in claim 10 in which said computer means includes means to sense the speed of rotation of each of said wheels, and means responsive to each of said wheel speed sensing means to nullify said operating period incident to rotation of any of said wheels at less than a predetermined rotary speed.

12. Apparatus as defined in claim 10 in which said apparatus comprises starting means for initiating rotation of said wheels, and means for stopping rotation of said wheels to terminate said playing period at respective positions each selected in accordance with information stored in said computer means.

13. Apparatus as defined in claim 12 in which said stored information is randomly generated by and stored in said computer means at the commencement of the operating period of said apparatus.

14. Apparatus as defined in claim 13 in which a disc and disc dispensing award means is provided and controlled by said computer means and operable to dispense a number of discs governed by the scoring information stored in said computer means.

15. Apparatus as defined in claim 12 in which said computer includes means to sense the speed of rotation of each of said wheels, and means responsive to each of said wheel speed sensing means effective to nullify the operating period incident to rotation of any of said wheels at less than a predetermined rotary speed.

16. Apparatus as defined in claim 1 in which said computer means comprises a plurality of random number code generating means each associated with a respective symbol displaying means and normally operating to continuously generate respective series of random number codes each defining a respective symbol of said corresponding symbol displaying means.

17. Apparatus as defined in claim 16 including stopping means for each of said symbol displaying means to effect termination of displaying of successive symbols by said symbol displaying means.

18. Amusement apparatus comprising computer means having information generating and storing means, a plurality of symbol displaying means operatively associated with said information generating and storing means each capable of displaying a plurality of differing symbols one at a time in series whereby at any time a set of such symbols is displayed, means under the control of said information generating and storing means for initiating cyclical display of the symbols thereof in serial order, and means for terminating the cyclical displaying of symbols to leave displayed a set of symbols consisting of one symbol from each of said symbol displaying means, said computer means including means operating normally to continuously generate a plurality of series of random number codes one for each of said symbol displaying means and to store that single random number code generated at a predetermined time relative to the commencement of cyclical operating of said symbol displaying means and thereafter to initiate operation of said means for terminating the cyclical display at respective points in the respective operation cycles of the displaying means to cause the latter to then display that particular set of symbols represented by said single random number code selected and stored during operation of all of said symbol displaying means.

19. Apparatus as defined in claim 18 characterized in the provision of playing disc dispensing means operatively associated with said computer means and effective to dispense playing discs determined in accordance with one of a plurality of scoring schedules stored in a memory means of said computer means.

20. Apparatus as defined in claim 19 characterized in that said computer means includes means for storing a plurality of differing scoring schedules, and said playing disc dispensing means being effective to dispense that number of discs in accord with a computer selected one of said scoring schedules.

21. Apparatus as defined in claim 18 in which said apparatus includes inhibiting means for inhibiting commencement of cyclical operation of said displaying means, and means for disabling said inhibiting means.

22. Apparatus as defined in claim 21 in which said apparatus includes manually operable means and in which said inhibiting means comprises means for locking said manually operable means against manual operation.

23. Apparatus as defined in claim 22 including a disc and disc utilizing means operating in conjunction with said computer means to dispense a disc under control of said computer means.

24. An amusement apparatus comprising:

first means, including a plurality of symbol-displaying means, each arranged to cyclically display in serial order a respective series of symbols when operated, and means for initiating cyclical operation of each of the symbol-displaying means;

second means, including stopping means for terminating operations of said symbol-displaying means after a plurality of cycles of operation of each thereof, whereby to display at the termination of said operation a set of symbols consisting of one symbol of each of said symbol displaying means;

third means, including operative computer means having random number code generating means, operatively connected to said first and second means, said computer means further comprising read-only memory means storing a control program and further comprising a random-access memory means and an operative operating unit, said computer means normally idly generating a continuum of random number codes and operable to store a random number code selected while all of said symbol-displaying means are continuing to display a respective series of symbols and to thereafter activate the respective stopping means each upon display by the respective displaying means of a respective symbol uniquely defined by the respective previously stored random number code, whereby determination of the ultimately displayed set of symbols is effected randomly by computer operation at the commencement of cyclical operation of said symbol-displaying means.

25. Amusement apparatus as defined by claim 24, including fourth means connected to said computer means for dispensing a play score only in event of final display of a predetermined set of said symbols.

26. Amusement apparatus as defined by claim 25 wherein said third means is effective to determine playing scores differing upon final display of respective differing predetermined combinations of symbols.

27. A device as defined in claim 25, including in said means for initiating cyclical operation of said symbol displaying means a plurality of discs and disc acceptance means, and manually-operable means with connections to said computer means effective upon operation of said manually-operable means and the disc-acceptance means to store then existing random number code generated by said computer means in said random-access memory of said computer means.

28. Amusement apparatus comprising:

means for accumulating a supply of discs of like specific characteristics and including means for dispensing discs therefrom;

a plurality of symbol displaying means each capable of displaying a single symbol and stopping means therefor, first means for initiating repetitive displaying of the respective symbols of each of said displaying means;

means normally acting to inhibit operation of said first means and effective upon application thereto of a disc of said specific characteristics to thereupon permit operation of said first means;

other means, including computer means operatively related to said first means and said inhibiting means, said other means comprising means normally effective to generate at high speed for each of said displaying means a continuing series of random number codes, and sensing means for repetitively sensing the displaying of the first symbol of each symbol-displaying means and providing thereby a respective start signal to said computer means, said computer means being effective to immediately store therein the current random number code corresponding to the respective displaying means incident to initiation of displaying of the symbols thereof and further effective thereafter to provide respective stopping signals to said stopping means at respective times determined by the respective previously stored random number code; whereby the set of individual symbols ultimately displayed, one by each displaying means, is determined by said other means at the time of initiation of operation of said first means;

and means in said computer means, connected to said disc-supply means, effective to cause actuation of the latter to dispense a playing disc incident upon ultimate displaying by said symbol-displaying means of a set of symbols conforming to a set thereof represented by a digital number stored in the memory of said computer means.

29. Amusement apparatus according to claim 28 characterized in that said computer means includes means for storing a plurality of digital numbers each representing differing numbers of playing discs, each such number of discs being represented by a respective different set of ultimately displayed symbols, and said computer means effective upon ultimate display of any of such different sets of symbols to cause said disc-supply means to dispense that number of disc represented by the respective displayed set of symbols.

30. That method of controlling the final display of a combination of n symbols comprising one symbol of each of n like series of symbols and the symbols of which series are cyclically serially displayed, which comprises randomly generating n series of digital number codes, one for each series of symbols, assigning each series of number codes to a respective series of symbols prior to cyclically displaying the symbols of the respective series thereof, storing one each of said codes generated at the time of commencement of cyclical displaying of the series of symbols, and subsequently terminating cyclical displaying of the series of symbols at respective points in the cyclical serial display represented by respective ones of the previously stored number codes, whereby determination of the set of symbols to be finally displayed is selected by random process at the time of initiation of the cyclical displaying of symbols.

31. A method of operating a gaming device having a number *n* of like cyclically operable symbol-displaying devices each operable to repetitively display in seriatim a series a,b,c, ... *x*, of symbols, which comprises producing for each displaying device a continuum of n series of random number codes each representative of the display of a respective one of the symbols, initiating the cyclical serial display of symbols by each of the displaying devices, storing the currently produced n random number codes at the time of initiating cyclical display of symbols, and subsequently terminating displaying of symbols by each of said displaying devices at that symbol represented by the respective previously stored random number code.

* * * * *

UNITED STATES PATENT AND TRADEMARK OFFICE

CERTIFICATE OF CORRECTION

PATENT NO. : 4,095,795

DATED : 20th June, 1978

INVENTOR(S) : JAMES C. SAXTON, BRUCE H. OSTERBERG and JOSEPH C. KAWAN

It is certified that error appears in the above-identified patent and that said Letters Patent are hereby corrected as shown below:

Claim 1, Col. 13, line 57, change "periOd" to --period--.

Claim 2, Col. 13, line 66, change "disc" to --discs--.

Claim 14, Col. 14, line 52, delete "award".

Claim 29, Col. 17, line 19, change "disc" to --discs--.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*